US006091315A

United States Patent [19]

Hofsäss

[11] Patent Number: 6,091,315

[45] Date of Patent: Jul. 18, 2000

[54] SWITCH HAVING A SAFETY ELEMENT

[76] Inventor: Marcel Hofsäss, Bodelschwinghstrasse 36, 75179 Pforzheim, Germany

[21] Appl. No.: 08/924,783

[22] Filed: Sep. 5, 1997

[30] Foreign Application Priority Data

Sep. 10, 1996 [DE] Germany ..... 196 36 640

[51] Int. Cl.[7] ..... H01H 37/00

[52] U.S. Cl. ..... 337/13; 337/3; 337/140; 337/380

[58] Field of Search ..... 337/3, 12, 13, 337/125, 140, 333, 365, 380, 388, 395

[56] References Cited

U.S. PATENT DOCUMENTS

| | | | |
|---|---|---|---|
| 4,563,667 | 1/1986 | Hofsäss . | |
| 4,679,023 | 7/1987 | Nelson . | |
| 4,885,560 | 12/1989 | Niino . | |
| 4,990,883 | 2/1991 | Escobar et al. | 337/357 |
| 5,670,930 | 9/1997 | Hofsäss et al. . | |

FOREIGN PATENT DOCUMENTS

| | | |
|---|---|---|
| 0041823 | 12/1981 | European Pat. Off. . |
| 0451678 | 10/1991 | European Pat. Off. . |
| 2511214 | 9/1976 | Germany . |
| 3114256 | 1/1984 | Germany . |
| 3234373 | 5/1984 | Germany . |
| 4337141 | 5/1995 | Germany . |
| 19521913 | 1/1996 | Germany . |

*Primary Examiner*—Leo P. Picard
*Assistant Examiner*—Jayprakash N. Gandhi
*Attorney, Agent, or Firm*—Harness, Dickey & Pierce, P.L.C.

[57] ABSTRACT

A switch has a switching mechanism, which switches at a response temperature, for opening and closing a circuit that can be connected to external terminals of the switch. In this context, the switching mechanism has a movable contact, electrically connected to one external terminal, which as a function of the temperature of a bimetallic part is in contact with a fixed contact that is electrically connected to the other external terminal. The switching mechanism further has a safety element that changes its shape into a high-temperature shape if its temperature reaches a transformation temperature which is above the response temperature. The movable contact is in contact with the fixed contact as a function of the temperature of the safety element.

8 Claims, 4 Drawing Sheets

SWITCH HAVING A SAFETY ELEMENT

BACKGROUND OF THE INVENTION

1. Field of the Invention

The present invention relates to a switch having a switching mechanism, which switches at a response temperature, for opening and closing a circuit that can be connected to external terminals of the switch, such that the switching mechanism comprises a movable contact, electrically connected to one external terminal, which as a function of the temperature of a bimetallic part is in contact with a fixed contact that is electrically connected to the other external terminal.

2. Related Prior Art

Switches of this kind, which are also referred to as temperature controllers, are generally known.

A basic distinction may be made between two different design variants of such switches. With the first configuration, the movable contact is held by a spring element that is clamped at one end; while with the second configuration, the movable contact is arranged approximately centeredly on a spring snap disk which is placed unconstrainedly into a housing and is braced with its rim against a housing part of the switch.

When the switch is incorporated with its external terminals into a circuit, with the switch closed current then flows via the one external terminal, through the fixed and movable contacts and the spring element, to the other external terminal. The spring element can be made either from a bimetallic or from spring steel.

If the spring element is made of a bimetallic, the result is a physically very simple design which nevertheless may have the disadvantage that the switching properties of the bimetallic can change due to internal electrical heating. This is prevented if a separate bimetallic part is provided which works against the force of the spring element.

Switches of this kind can be configured as normally-closed or normally-open switches; above its response temperature, the bimetallic part then either pushes the movable contact away from the fixed contact, or brings it into contact therewith.

It is also known to associate series and/or parallel resistances with such switches in order to attain further switching properties. A resistance connected in parallel imparts a self-hold function to a switch which opens in response to over-temperature: the bimetallic part is held at a temperature above its response temperature (and thus in the open state) by the resistive heat generated in the resistance.

A series resistance additionally imparts a current sensitivity to a switch equipped therewith: the current flowing through the switch heats the series resistance, such that the resistive heat generated therein causes the temperature of the bimetallic part to be elevated above the response temperature (and thus causes the switch to open) if the flowing current has exceeded a certain limit value.

Switches of this kind are, for example, connected in series with a load being protected, so as to protect the latter from over-temperature and/or overcurrent. They are utilized in particular to protect electric motors, transformers, household electrical appliances, etc.

It is known that the switching behavior of the bimetallic part changes over time: as a result of age, the switching temperature shifts upward by as much as 30 degrees C., which can lead to safety problems. In order to eliminate this problem, it is already known to connect, in series with a switch of this kind, a separate safety fuse which opens above the response temperature of the switch but below the maximum allowable temperature. Safety fuses of this kind are used in particular in transformers, where temperature controllers without self-holding are used only in conjunction with a safety fuse that is connected in series.

If the switch does not switch at the desired response temperature due to aging of the bimetallic part or some other defect, the temperature of the device which is being monitored, and with which the switch is thermally connected, rises until the melting temperature of the safety fuse is reached. The safety fuse then opens, so that the circuit powering the electrical load being protected is irreversibly interrupted.

The additional use of a safety fuse of this kind entails, however, a number of disadvantages. Firstly, two separate components must be installed on the device being protected, which not only increases the time required for assembly but also requires additional installation space. This is particularly disadvantageous because known safety fuses are very bulky, so that appropriate space on the device being protected must be provided.

SUMMARY OF THE INVENTION

In view of the above, it is an object of the present invention to improve the switch mentioned at the outset in such a way that the aforementioned safety and assembly problems are eliminated with a simple design. The new switch is intended in particular, with a simple design, to have additional protection against aging of the bimetallic part.

According to the invention, this object is achieved in the case of the switch mentioned at the outset by the fact that the switching mechanism comprises a safety element that changes its shape into a high-temperature shape if its temperature reaches a transformation temperature which is above the response temperature; and that the movable contact is in contact with the fixed contact as a function of the temperature of the safety element.

The object underlying the invention is completely achieved in this manner.

Specifically, the inventor of the present application has recognized that integration of a further temperature dependency into the switching mechanism makes it possible on the one hand to dispense with the disadvantageous safety fuse, but on the other hand reliably to prevent a maximum permissible temperature from being exceeded. The safety element can be used equally well for switches which open or close in response to overtemperature. It is particularly advantageous here that only a single component needs to be installed on the device being protected: the safety function of the safety fuse is now, so to speak, integrated into the new switch.

This safety element can, for example, be a further bimetallic element that has a much higher response temperature than the bimetallic part used for the usual switching operations. Since the response temperature of the bimetallic element is much higher than that of the bimetallic part, the bimetallic element does not experience to the same degree the aging processes to which the bimetallic part used for switching is subject. In design terms it is possible, for example, to connect the bimetallic element mechanically in parallel with the bimetallic part, so that it performs the same function as the bimetallic part but at a higher response temperature (the maximum safety temperature referred to here as the transformation temperature).

In a preferred embodiment, the safety element, in its high-temperature shape, holds the movable contact in a safety position which it retains even if the temperature of the safety element again drops below the transformation temperature.

The advantage here is that, so to speak, a mechanical self-holding function is achieved: once opened or closed by the safety element, the switch remains in that state even if the external temperature drops again. It is possible here, for example, to provide a locking lug on the switch, behind which the movable contact, or a part carrying it, engages. This locking lug can be arranged and configured so that it is utilized only if the safety element has transitioned into its high-temperature shape.

A further advantage of this design is that the safety position can be manually unlocked again, thus creating a mechanically self-locking but resettable temperature controller.

In an embodiment, it is preferred if the safety element is produced from a shape-memory alloy.

The advantage here is that shape-memory alloys of this kind, which are also referred to as "memory metals," have different switching and aging characteristics from bimetallic parts. The shape-memory alloys, however, exhibit slower switching characteristics than bimetallic parts. In this embodiment, it is advantageous if the bimetallic part is used for fast switching, and the safety element made of shape-memory alloy is used for reliable and irreversible deactivation if a maximum temperature, i.e. the transformation temperature of the safety element, is exceeded.

Shape-memory alloys of this kind have been known for several years; they are characterized by the fact that when the transformation temperature is exceeded, they reassume their high-temperature shape regardless of the shape into which they were previously formed when cold. Further information about such shape-memory alloys is available, for example, in the collective work "Alloys with shape memory" [Legierungen mit Formgedächtnis], Kontakt und Studium, Vol. 259, Expertverlag, Ehningen, 1988; or Spektrum der Wissenschaft, 1980, Vol. 1, pp. 48–57, Donald Schetky: "Alloys that remember shapes [Legierungen, die sich an Form erinnern]".

It is particularly preferred if the shape-memory alloy retains its high-temperature shape even if its temperature again drops below the transformation temperature.

This exploits the so-called one-way effect, which occurs when a shape-memory alloy in the martensitic state is permanently deformed in the range below a critical degree of deformation. Upon heating to the transformation temperature, which can lie in the range between −150 and +150 degrees C., the original shape returns and is retained even upon cooling.

The advantage here is that the safety element itself ensures that the movable contact element remains permanently in its safety position, so that the aforementioned snap lug, or similar mechanical catch means, can be dispensed with. In other words, once the safety element has been heated to a temperature above its transformation temperature, it irreversibly assumes its high-temperature shape in which it permanently holds the movable contact element either in contact with the fixed contact element or out of contact with the fixed contact element, depending on whether the switch is normally-open or normally-closed. The advantage of this application thus lies especially in the physically simple configuration which the new switch has, because a shape-memory alloy with the one-way effect is used as the safety element.

In an embodiment, it is preferred if the safety element is a compression spring or tension spring.

This feature is also advantageous in terms of design: the compression spring or tension spring made of shape-memory alloy, now available commercially, must simply be arranged suitably in the housing, for example between the spring element and a stop fixed to the housing. Further design changes to known switches are not necessary.

It is preferred in general terms if the switching mechanism comprises a spring element, clamped at one end, at whose free end the movable contact is arranged; and if the safety element, in its high-temperature shape, acts on the spring element.

The advantage here is that temperature controllers of ordinary configuration can be equipped with an additional safety function. In this context, the spring element is made either itself of a bimetallic or of spring steel on which the bimetallic part acts. Existing temperature controllers of this configuration can easily be redesigned by additionally integrating into the switching mechanism a compression spring or tension spring made of a shape-memory alloy. In the simplest case, it is possible to retain existing designs and to arrange the additional spring in a suitable space in the region of the switching mechanism.

On the other hand, it is preferred if the switching mechanism comprises a spring snap disk which carries the movable contact approximately centeredly, and is braced peripherally against a housing part by means of which it is electrically connected to the external terminal; and if the safety element acts on the spring snap disk.

This embodiment is a different and common configuration of temperature controllers, in which the movable contact is carried by a spring snap disk made either of a bimetallic or of spring steel. The spring snap disk is generally placed unconstrainedly into a lower housing part which either is made of metal or carries on its base an insert on which the spring snap disk is braced at its rim, and which is connected externally to the external terminal. This lower housing part is closed off by a cover part which is produced either from electrically conductive material or from insulating material. If both the cover part and the lower housing part are electrically conductive, they are electrically insulated from one another by means of an insulating film. If only one of the two housing parts is electrically conductive, contact is usually made on the one hand to that electrically conductive housing part, and on the other hand through the wall of the other housing part. It is also possible to produce both housing parts from electrically insulating or electrically conductive material.

The spring snap disk is usually produced from spring steel. In the case of a temperature controller configured as a normally-closed switch, below the response temperature this spring snap disk presses the movable contact against the fixed contact, so that the current flowing through the switch passes through the spring disk. Slipped over the contact is a bimetallic snap disk which, above the response temperature, pushes the movable contact away from the fixed contact against the force of the spring snap disk, for which purpose it is braced peripherally against a housing part.

Known temperature controllers of this kind can according to the present invention easily be equipped with an additional safety function if a safety element is provided as an additional part of the switching mechanism and acts on the spring snap disk.

It is preferred in this context if the safety element is a disk which is slipped over the movable contact and is braced, at least in its high-temperature shape, against a housing part.

The simple physical design is an advantage with this feature: all that is necessary is to place a further disk into a known temperature controller, and no further design changes are needed in order to equip the new switch with the additional safety function. All that is necessary for this purpose, therefore, is to add a further disk to an ordinary switching mechanism consisting of a spring snap disk and optionally a bimetallic snap disk.

It is further preferred if the disk is retained peripherally on a housing part, and preferably is held at the periphery on a shoulder between a lower housing part and a cover part.

The advantage here is that the disk does not participate in the movements of the switching mechanism at low temperatures, i.e. is not mechanically stressed as long as the transformation temperature is not exceeded. This ensures, in very simple fashion, that the bimetallic part and the safety element are subject to different aging processes.

BRIEF DESCRIPTION OF THE DRAWINGS

Further advantages are evident from the description and the appended drawings.

It is understood that the features mentioned above and those yet to be explained below can be used not only in the respective combinations indicated, but also in other combinations or in isolation, without leaving the context of the present invention.

Figure 1:
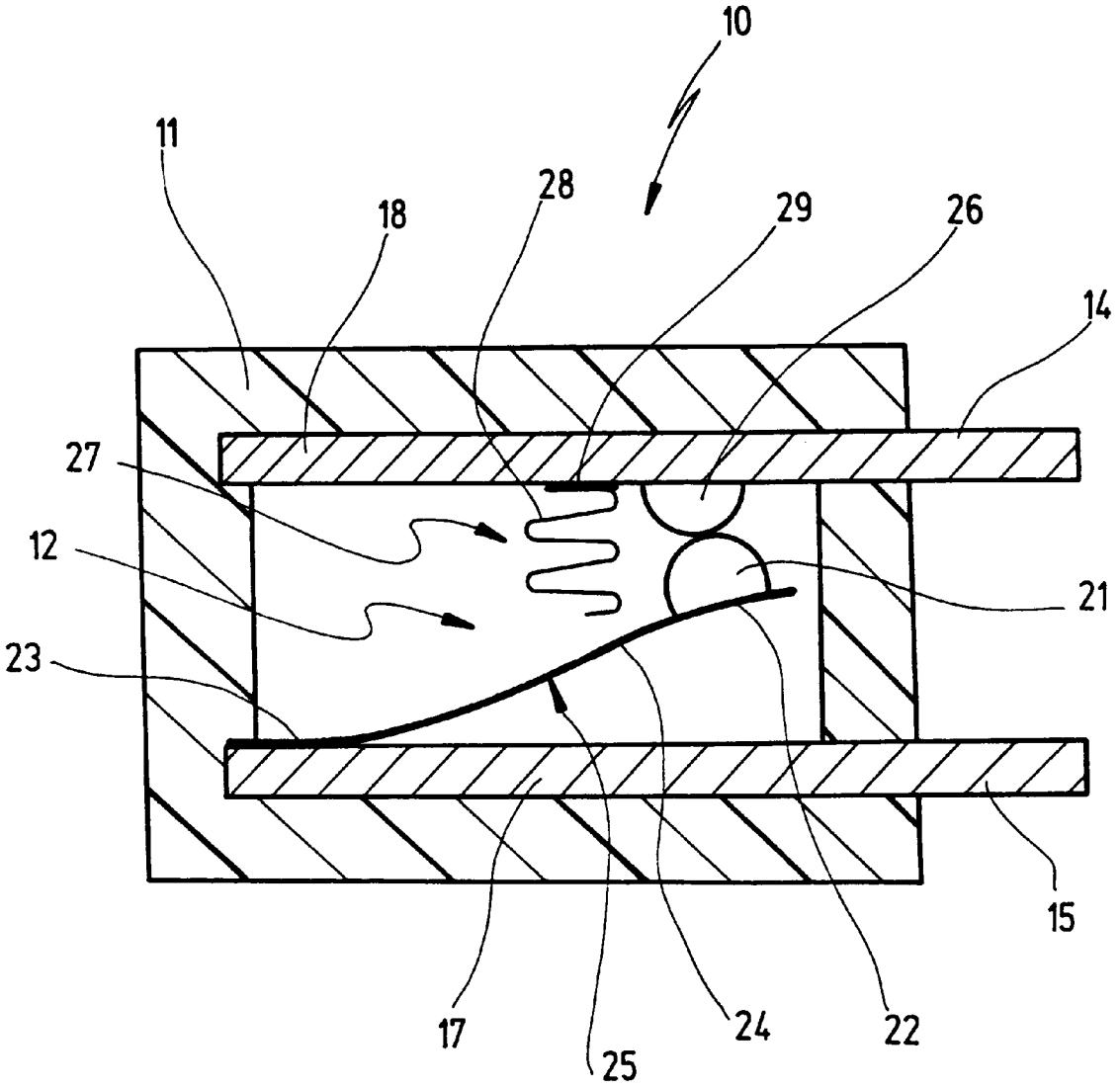
Figure 2:
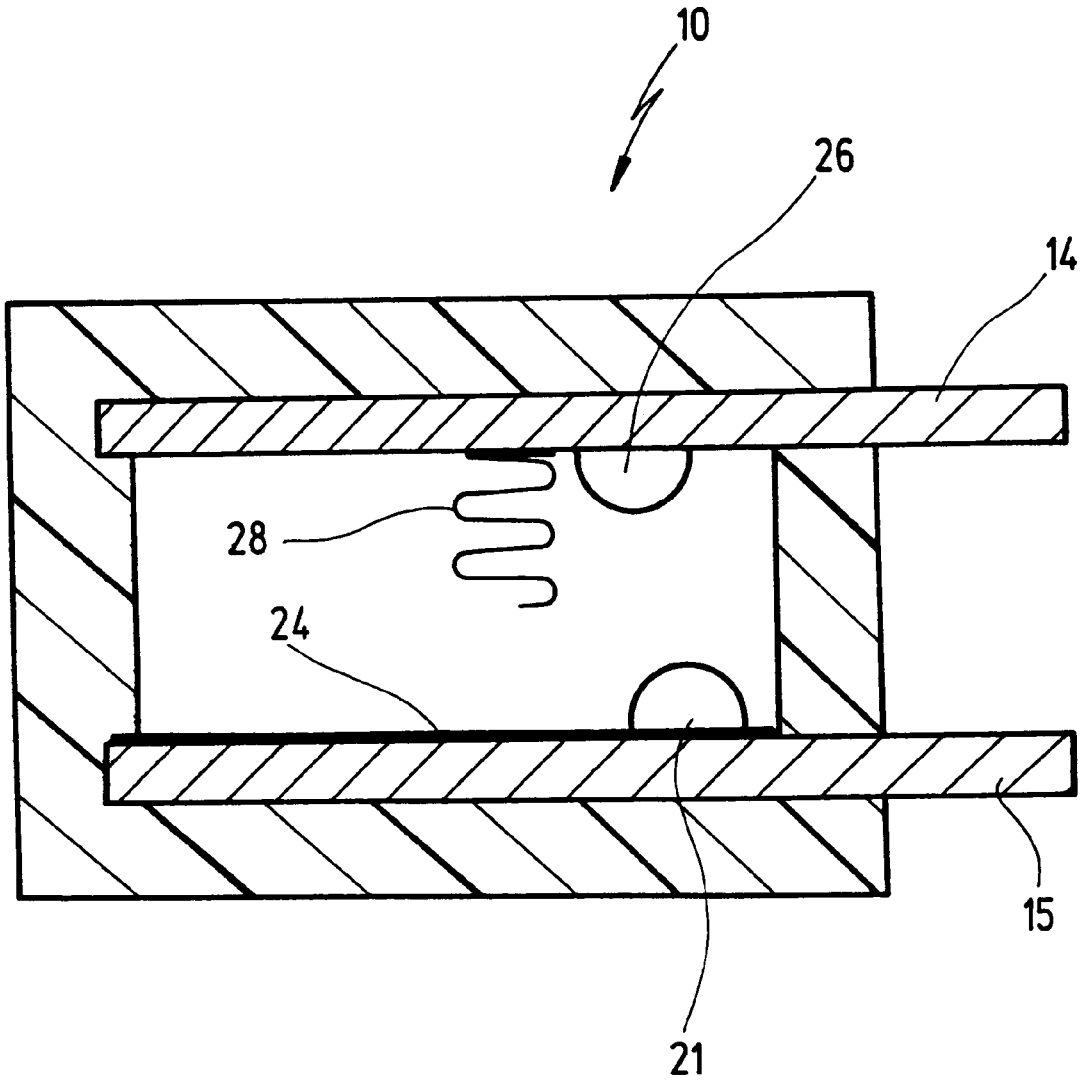
Figure 3:
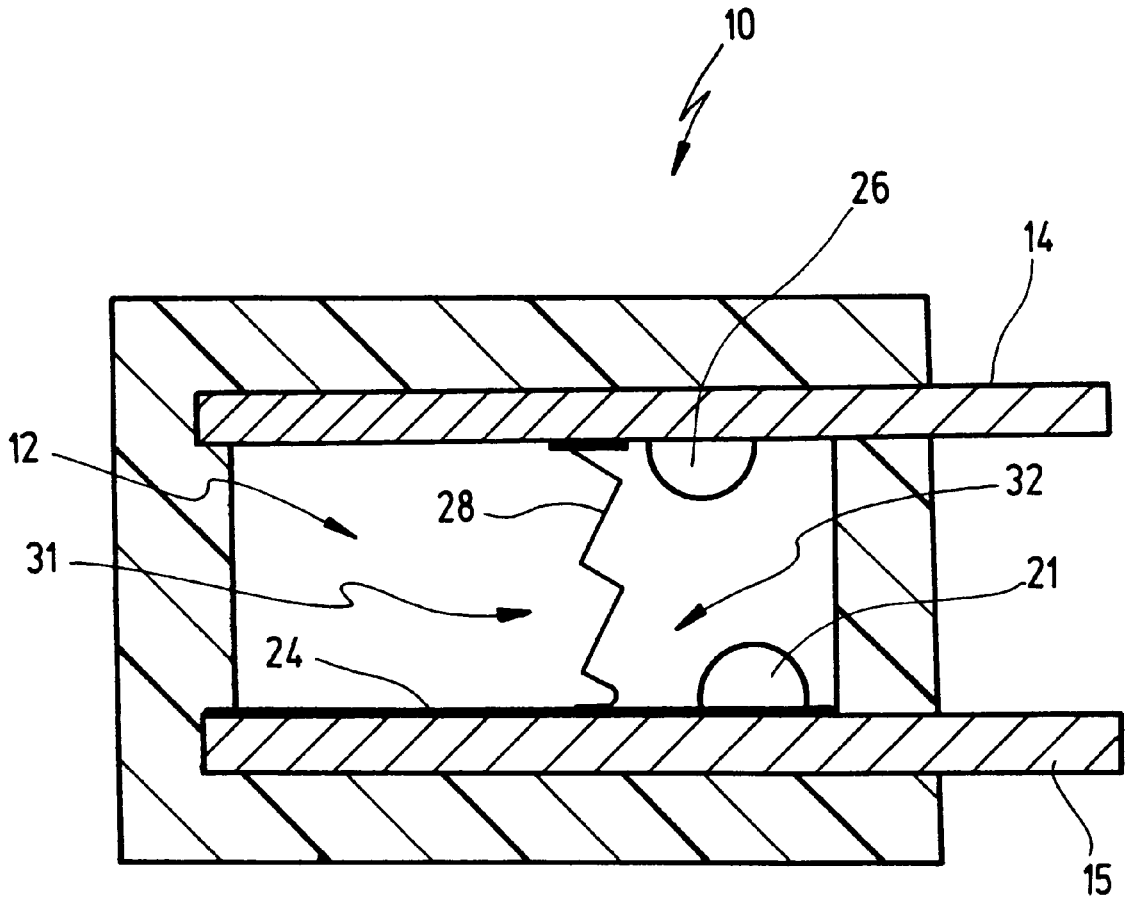
Figure 4:
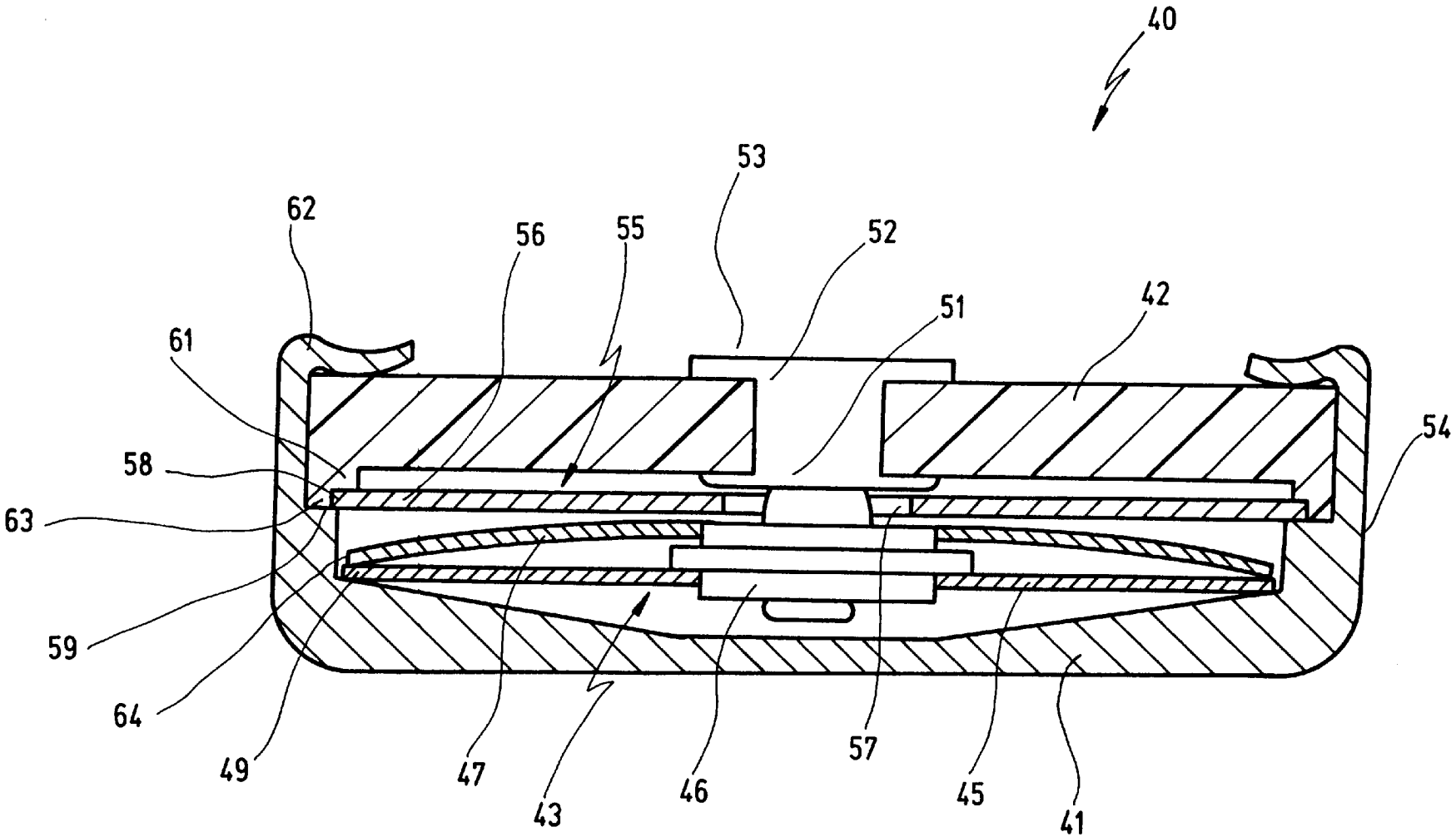

The invention is shown in the drawings and will be explained in more detail in the description below. In the drawings:

FIG. 1 shows a first embodiment of the new switch, the switching mechanism being below the response temperature;

FIG. 2 shows the switch of FIG. 1, the switching mechanism having assumed a temperature above the response temperature;

FIG. 3 shows a switch as in FIGS. 1 and 2, the switching mechanism having now assumed a temperature above the transformation temperature; and FIG. 4 shows a further embodiment of the new switch, the switching mechanism having a temperature below the response temperature.

DETAILED DESCRIPTION OF PREFERRED EMBODIMENTS

In FIG. 1, 10 designates the entirety of a switch which is shown therein schematically in longitudinal section. Switch 10 comprises a housing 11 made of insulating material, in which a temperature-dependent switching mechanism 12 is arranged.

Switch 10 has two external terminals 14, 15, by means of which it is connected in series with an electrical load being protected, and with its supply voltage. Arranged in the interior of switch 10 are two contact bars 17, 18 which are electrically connected to external terminals 15 and 14, respectively.

Switching mechanism 12 comprises a movable contact 21 that is arranged at one free end 22 of a spring element 24 that is attached at its other end 23 to contact bar 17. In the embodiment shown, spring element 24 is a bimetallic part 25 that, in the position shown in FIG. 1, presses movable contact 21 against a fixed contact 26 that is attached to upper contact bar 18.

In the position shown in FIG. 1, switch 10 is closed: a low-resistance electrically conductive connection exists between the two external terminals 14 and 15 via contact bar 18, fixed contact 26, movable contact 21, spring element 24, and contact bar 17.

If the temperature of spring element 24 is then raised above the response temperature, spring element 24 moves movable contact 21 away from fixed contact 26 as a result of the deformation of the bimetallic material, so that the switch assumes the position sketched in FIG. 2, in which no further electrically conductive connection exists through switch 10 between external terminals 14 and 15. If the temperature of spring element 24 again drops below the response temperature, switch 10 closes again.

Switch 10 further comprises a safety element 27 in the form of a compression spring 28 made of a shape-memory alloy. Compression spring 28 is attached via an insulator 29 to upper contact bar 18.

In the temperature ranges which correspond to the positions of switch 10 of FIGS. 1 and 2, compression spring 28 retains its helical shape shown therein. If, however, the temperature of the compression spring rises above a transformation temperature that is higher than the response temperature, its shape transforms into the high-temperature shape 31 shown in FIG. 3, in which it pushes spring element 24 into the safety position indicated as 32.

Compression spring 28 is produced from a shape-memory alloy with a one-way effect, which means that compression spring 28 retains its high-temperature shape 31 even if the temperature again drops to well below the transformation temperature. This means that compression spring 28 holds switch 10 permanently open even if the temperature drops again. It is of course necessary for this purpose that the force exerted on spring element 24 by compression spring 28 in its high-temperature shape 31 be greater than the closing force with which spring element 24 presses movable contact 21 toward fixed contact 26.

The spring constants of spring element 24 and of compression spring 28 necessary for this purpose can be set by selection of the alloys and by ordinary deformation.

FIG. 4 shows a second embodiment of a switch 40 which comprises a lower housing part 41 and a cover part 42 closing off the latter. A temperature-dependent switching mechanism 43, indicated at 43, is arranged in lower housing part 41.

Switching mechanism 43 comprises a spring snap disk 45, placed unconstrainedly into lower housing part 41, which carries approximately centeredly a movable contact 46 over which a bimetallic snap disk 47 is slipped. Spring snap disk 45 is braced with its rim 49 against the interior of lower housing part 41, and thereby presses movable contact 46 against a fixed contact 51 provided on the interior of cover part 42. Fixed contact 51 extends, in the manner of a rivet 52, through cover part 42, and transitions externally into a first external terminal 43. In the case of switch 40 of FIG. 4, lower housing part 41 constitutes a second external terminal 54 because it is produced from electrically conductive material, while cover part 42 is made of electrically insulating material.

Switching mechanism 43 also has a safety element 55 in the form of a disk 56 made of a shape-memory alloy. Disk 56 is slipped at its center hole 57 over movable contact 46, and is braced at its rim 58 against a shoulder 59 of lower housing part 41. Cover part 42 sits on rim 58 at a circular annular projection 61. Cover part 42 is held in lossproof fashion on lower housing part 41 by means of a crimped rim 62 of the latter. To allow rim 58 of disk 56 a certain mobility with respect to shoulder 59, a peripheral collar 63, which rests directly on shoulder 59, is provided on annular projection 61. The clearance between annular projection 61 and rim 58 of disk 56 is not visible in FIG. 4 for reasons of simplicity.

The position of switch 40 in FIG. 4 corresponds to the position of switch 10 in FIG. 1: bimetallic snap disk 57 is below its response temperature. If the temperature of bimetallic snap disk 47 increases above the response temperature, it presses with its rim 64 from below against disk 56, thereby pressing movable contact 46 away from fixed contact 51 against the force of spring snap disk 45. The position then assumed by switch 40 corresponds to that shown in FIG. 2 for switch 10.

If the temperature of bimetallic snap disk 47 drops again, switch 40 returns to the position shown in FIG. 4.

It may happen, because of aging processes, that the response temperature of bimetallic snap disk 47 increases by up to 30 degrees C., so that it lies above a transformation temperature of disk 56. If the temperature of bimetallic snap disk 47 and of disk 56 then reaches the transformation temperature, bimetallic snap disk 47 may then not yet respond, but disk 56 does transition into its high-temperature shape, in which it assumes a concave shape and pushes movable contact 46 away from fixed contact 51 against the force of spring snap disk 45 and bimetallic snap disk 47. This high-temperature shape of disk 56 is irreversible, being retained even if the temperature again drops substantially, so that switch 40 remains permanently open once it has been heated to a temperature above the transformation temperature of disk 56.

What is claimed is:

1. A switch, comprising:

two external terminals for connection to a circuit, a temperature-dependent switching mechanism that above a response temperature interrupts and closes, respectively, said circuit when connected, said switching mechanism comprising:

a fixed contact electrically connected to one of said two external terminals, and a moving contact electrically connected to the other of said two external terminals, a bimetallic part acting on said movable contact such that the latter is in contact with the fixed contact depending on the temperature of the bimetallic part, and a safety element produced from a shape-memory alloy that changes its shape into a high-temperature shape if its temperature reaches a transformation temperature which is above the response temperature, the safety element, in its high-temperature shape, holding the movable contact in a safety position which it retains even if the temperature of the safety element again drops below the transformation temperature, wherein the safety element is a compression spring.

2. A switch, comprising:

two external terminals for connection to a circuit, a temperature-dependent switching mechanism that above a response temperature interrupts and closes, respectively, said circuit when connected, said switching mechanism comprising:

a fixed contact electrically connected to one of said two external terminals, and a moving contact electrically connected to the other of said two external terminals, a bimetallic part acting on said movable contact such that the latter is in contact with the fixed contact depending on the temperature of the bimetallic part, and a safety element produced from a shape-memory alloy that changes its shape into a high-temperature shape if its temperature reaches a transformation temperature which is above the response temperature, the safety element, in its high-temperature shape, holding the movable contact in a safety position which it retains even if the temperature of the safety element again drops below the transformation temperature, wherein the safety element is a tension spring.

3. A switch, comprising:

two external terminals for connection to a circuit, a temperature-dependent switching mechanism that above a response temperature interrupts and closes, respectively, said circuit when connected, said switching mechanism comprising:

a fixed contact electrically connected to one of said two external terminals, and a moving contact electrically connected to the other of said two external terminals, a bimetallic part acting on said movable contact such that the latter is in contact with the fixed contact depending on the temperature of the bimetallic part, and a safety element that changes its shape into a high-temperature shape if its temperature reaches a transformation temperature which is above the response temperature, wherein the switching mechanism comprises a spring element, clamped at one end, at whose free end the movable contact is arranged; and the safety element, in its high-temperature shape acts on the spring element.

4. A switch, comprising:

two external terminals for connection to a circuit, a temperature-dependent switching mechanism that above a response temperature interrupts and closes, respectively, said circuit when connected, said switching mechanism comprising:

a fixed contact electrically connected to one of said two external terminals, and a moving contact electrically connected to the other of said two external terminals, a bimetallic part acting on said movable contact such that the latter is in contact with the fixed contact depending on the temperature of the bimetallic part, and a safety element that changes its shape into a high-temperature shape if its temperature reaches a transformation temperature which is above the response temperature, wherein the switching mechanism comprises a spring snap disk which carries the movable contact approximately centeredly, and is braced peripherally against a housing part by means of which it is electrically connected to the external terminal; and the safety element acts on the spring snap disk.

5. The switch of claim 4, wherein associated with the spring snap disk is a bimetallic snap disk which is slipped over the movable contact and which, above the response temperature, is braced peripherally against a housing part.

6. The switch of claim 4, wherein the safety element is a disk which is slipped over the movable contact and is braced, at least in its high-temperature shape, against a housing part.

7. The switch of claim 6, wherein the disk is retained peripherally on a housing part.

8. The switch of claim 7, wherein the disk is held peripherally on a shoulder between a lower housing part and a cover part.

* * * * *